US006881089B1

(12) United States Patent
Yang

(10) Patent No.: US 6,881,089 B1
(45) Date of Patent: Apr. 19, 2005

(54) INTERFACE CARD ANCHORING STRUCTURE

(75) Inventor: Tzu-Yi Yang, Taipei (TW)

(73) Assignee: Inventec Corporation, Taipei (TW)

( * ) Notice: Subject to any disclaimer, the term of this patent is extended or adjusted under 35 U.S.C. 154(b) by 0 days.

(21) Appl. No.: 10/916,459

(22) Filed: Aug. 12, 2004

(51) Int. Cl.[7] ..... H01R 13/64
(52) U.S. Cl. ..... 439/377; 439/328; 361/801
(58) Field of Search ..... 439/328, 377; 361/801, 759

(56) References Cited

U.S. PATENT DOCUMENTS 3,539,879 A * 11/1970 Leahy et al. ..... 361/756
3,932,016 A * 1/1976 Ammenheuser ..... 439/377
4,233,646 A * 11/1980 Leung et al. ..... 361/752
4,313,150 A * 1/1982 Chu ..... 361/755
4,498,722 A * 2/1985 Fedder et al. ..... 439/260
4,579,411 A * 4/1986 Cobaugh et al. ..... 439/327
4,632,588 A * 12/1986 Fitzpatrick ..... 403/16
5,594,627 A * 1/1997 Le ..... 361/801
5,647,755 A * 7/1997 Hida et al. ..... 439/328
5,672,072 A * 9/1997 Arai et al. ..... 439/377
5,967,633 A * 10/1999 Jung ..... 312/223.2
5,982,627 A * 11/1999 Haughton et al. ..... 361/759
6,083,026 A * 7/2000 Trout et al. ..... 439/328
6,159,031 A * 12/2000 Llapitan et al. ..... 439/326
6,160,707 A * 12/2000 Yin ..... 361/704
6,181,565 B1 * 1/2001 Schmitt et al. ..... 361/756
6,210,203 B1 * 4/2001 Ma ..... 439/377
6,735,091 B1 * 5/2004 Megason et al. ..... 361/801
6,816,388 B1 * 11/2004 Junkins et al. ..... 361/801
2004/0184252 A1 * 9/2004 Lin et al. ..... 361/801

* cited by examiner

*Primary Examiner*—Gary Paumen
*Assistant Examiner*—Larisa Tsukerman
(74) *Attorney, Agent, or Firm*—Harness, Dickey & Pierce, PLC

(57) ABSTRACT

An interface card anchoring structure is mounted on a bracket of a case of an electronic device corresponding to an insertion slot of a main board of the case. The bracket has two opposing inner sides that have respectively an opening and a trough formed thereon. The interface card anchoring structure includes a pivot lug and a coupling assembly. The pivot lug is located on one inner side where the opening is formed. The coupling assembly can selectively latch one corner of the interface card after the interface card has been wedged in the bracket to anchor a connector of the interface card in the insertion slot of the main board.

4 Claims, 4 Drawing Sheets

INTERFACE CARD ANCHORING STRUCTURE

FIELD OF THE INVENTION

The present invention relates to an anchoring structure adopted for use on interface cards and particularly to an anchoring structure for anchoring the connector of an interface card in an insertion slot of a main board.

BACKGROUND OF THE INVENTION

In a conventional electronic device, one of the designs often adopted is to latch one end of an interface card in a trough of the case of the electronic device after the interface card has been wedged in an insertion slot of the main board. The connector of the interface card is prone to break away from the insertion slot when subject to vibration or during transportation. This results in poor connection.

To remedy the aforesaid problem, many improved techniques have been developed. Two kinds of techniques are discussed below as examples.

An interface card auxiliary coupling apparatus has a base wedging in a trough abutting one side of a case, and a bucking member is pivotally coupled on the base that can selectively compress the upper side of the interface card to prevent the interface cards from breaking away from the insertion slots of a main board and forming poor connection, or not compress the upper side of the interface card to allow the interface card to be removed easily from the insertion slot.

The other technique is a computer interface card loosening inhibited mechanism. After one end of the interface card is wedged in an insertion slot of the case of an electronic device, the interface card loosening inhibited mechanism located in a computer may be movably mounted on a plurality of interface cards above the insertion slots in a latched condition to prevent the interface cards from breaking away from the insertion slots of a main board and forming poor connection, or allow the interface cards to be removed from the insertion slots in a unlatched condition.

The aforesaid structures are movably mounted on the case abutting the trough to selectively remove the interface card or prevent the interface card from being removed. There is another design to confine one end of the interface card not wedged in the trough as shown in FIG. 1. It has a hook to latch the interface card to prevent the interface card from breaking away. However, to remove the interface card from the trough, many locations have to be forced. This is not convenient.

SUMMARY OF THE INVENTION

The primary object of the invention is to provide an interface card anchoring structure to rapidly anchor a connector of an interface card in an insertion slot of a main board or disengage the connector from the insertion slot.

The interface card anchoring structure according to the invention is located on a bracket of the case of an electronic device corresponding to an insertion slot of a main board. The bracket has an opening and a trough on two opposing inner sides. The invention includes a pivot lug and a coupling assembly. The pivot lug is located on one inner side where the opening is formed. The coupling assembly includes an elastic element and a housing element. The housing element has one end connected to the elastic element and the other end movably coupled on the pivot lug, and has a housing trough corresponding to the interface card, and remote from the opening.

When the interface card is inserted in the bracket through the trough, the elastic element is moved to compress the inner side where the opening is formed to store elastic force, and the housing element is pushed outwards through the opening. When the interface card has been inserted in the housing trough, the elastic force of the elastic element drives the elastic element and the housing element to their original positions to latch a corner of the interface card so that the connector of the interface card is anchored in the insertion slot of the main board.

By contrast, push the housing element to compress the elastic element to store the elastic force and turn the housing element outwards through the opening to unlatch the corner of the interface card, then the interface card may be removed from the main board through the trough to disengage the connector of the interface card from the insertion slot of the main board.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
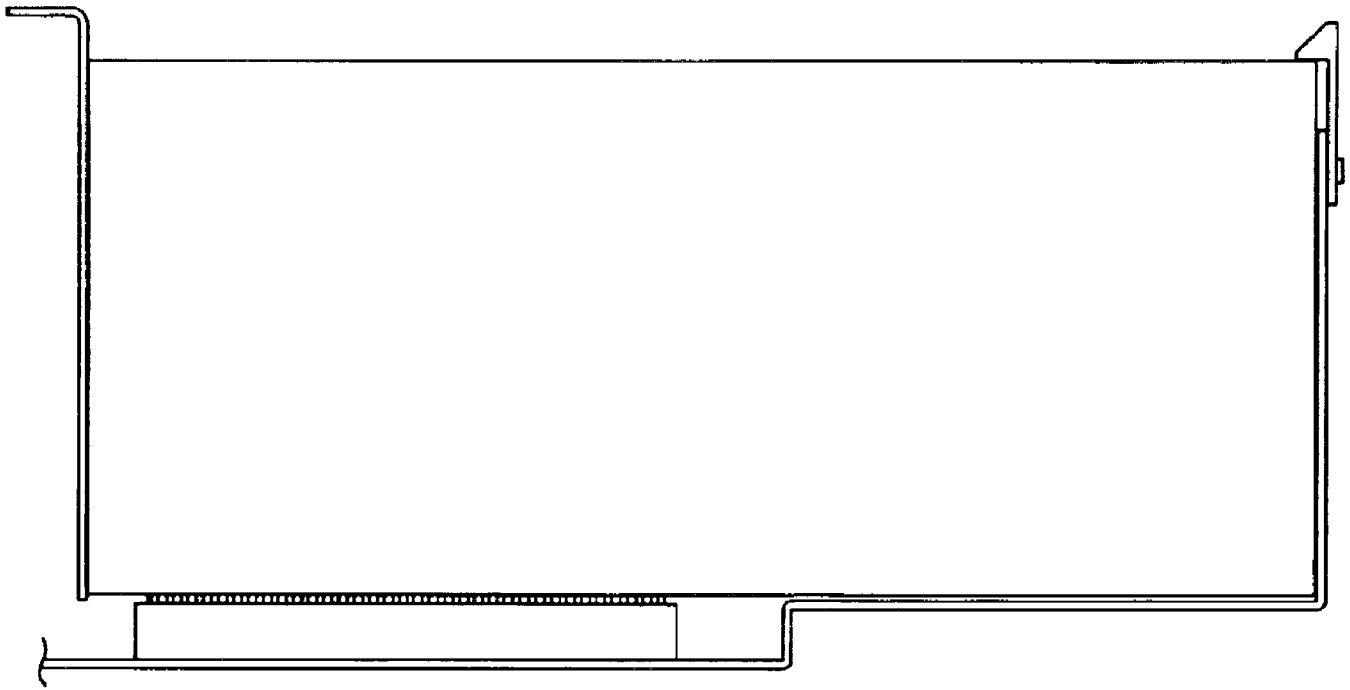
FIG. 1 (PRIOR ART)
FIG. 1 is a schematic side view of a conventional interface card anchoring structure.
Figure 2:
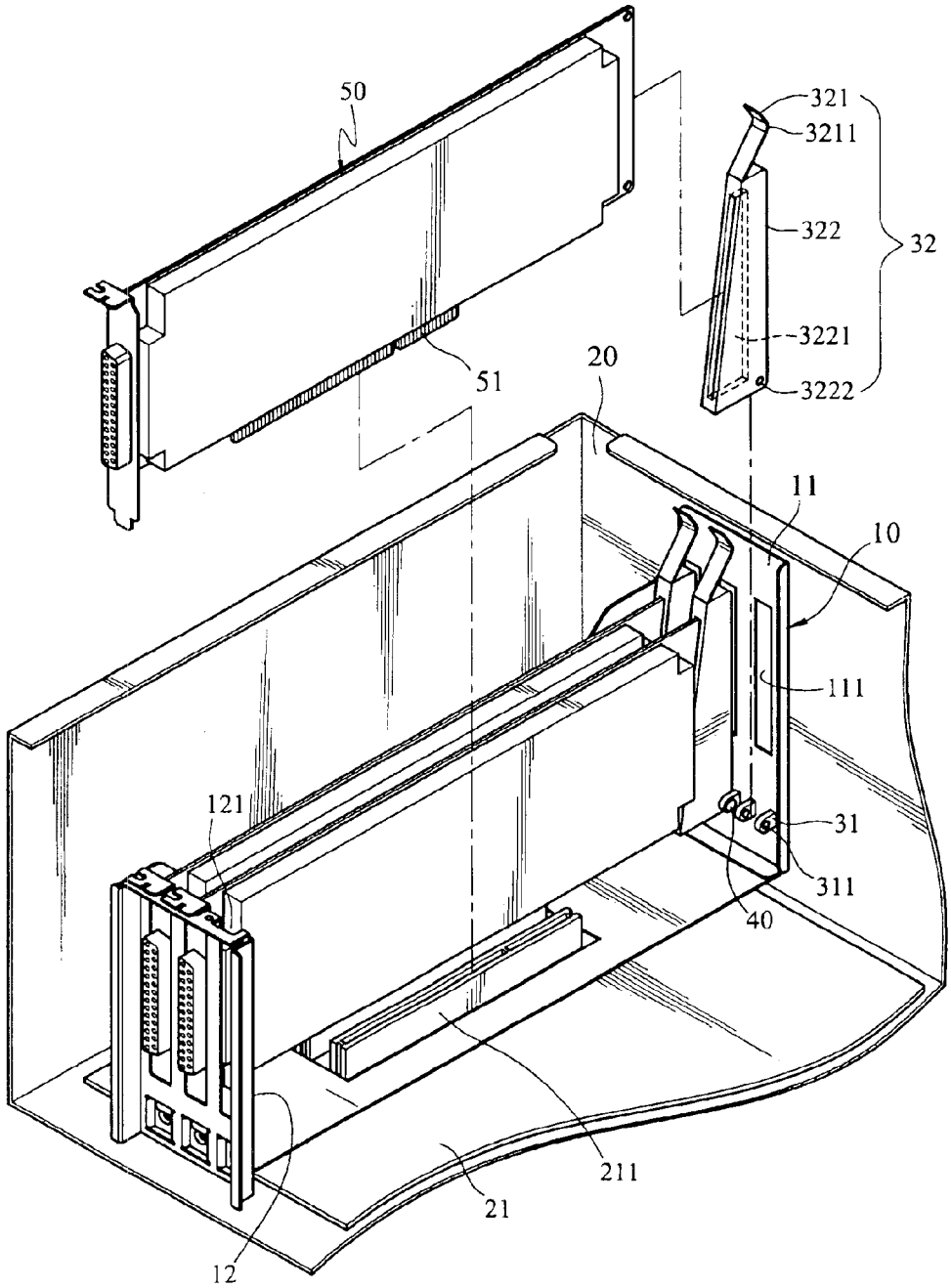
FIG. 2 is a perspective view of the invention.

Referring to FIG. 2, the interface card anchoring structure according to the invention is mounted on a bracket 10 located in a case 20 of an electronic device corresponding to an insertion slot 211 of a main board 21 in the case 20. The bracket 10 has two inner sides 11 and 12 opposing each other. The inner sides 11 and 12 have respectively an opening 111 and a trough 121. The invention includes a pivot lug 31 and a coupling assembly 32.

The pivot lug 31 is located on the inner side 11 of the bracket 10 where the opening 111 is formed and has a pivot hole 311. The coupling assembly 32 includes an elastic element 321 and a housing element 322.

The elastic element 321 is an elastic reed having an elastic section 3211 to press the inner side 11.

The housing element 322 has one end connected to the elastic element 321 and the other end formed an aperture 3222 to couple with the pivot hole 311 through a fastening element 40 so that the housing element 322 is pivotally coupled on the pivot lug 31. The housing element 322 further has a housing trough 3221 corresponding to an interface card 50 and remote from the opening 111.

Figure 3A:
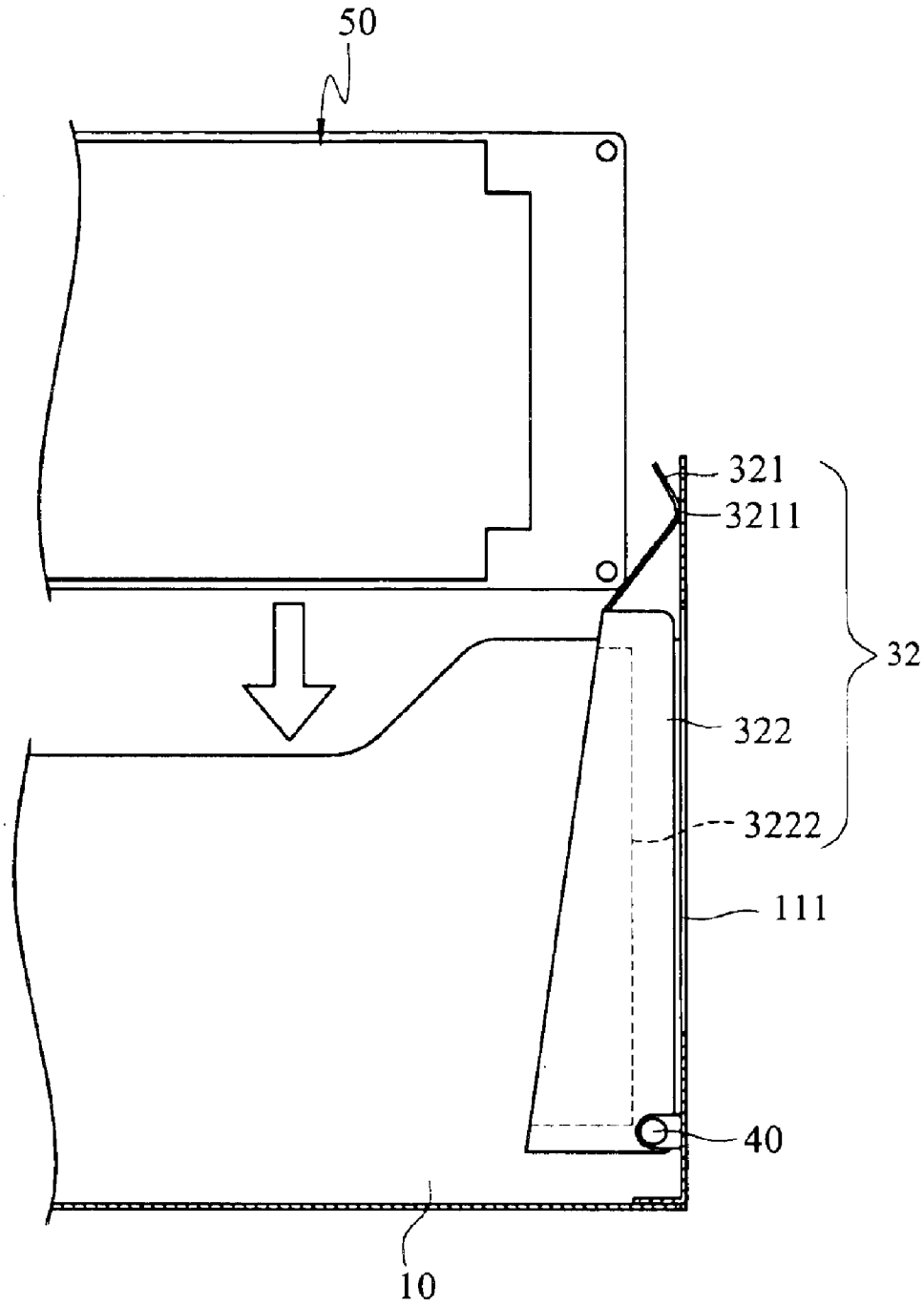
FIGS. 3A, 3B and 3C are schematic views of the invention in an anchoring operation.
Figure 3B:
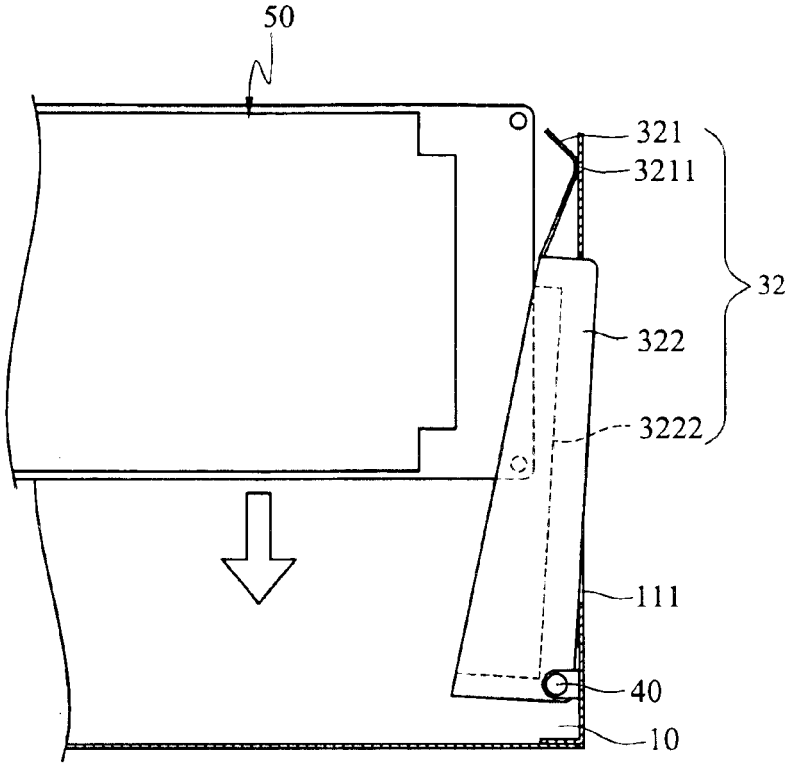
Figure 3C:
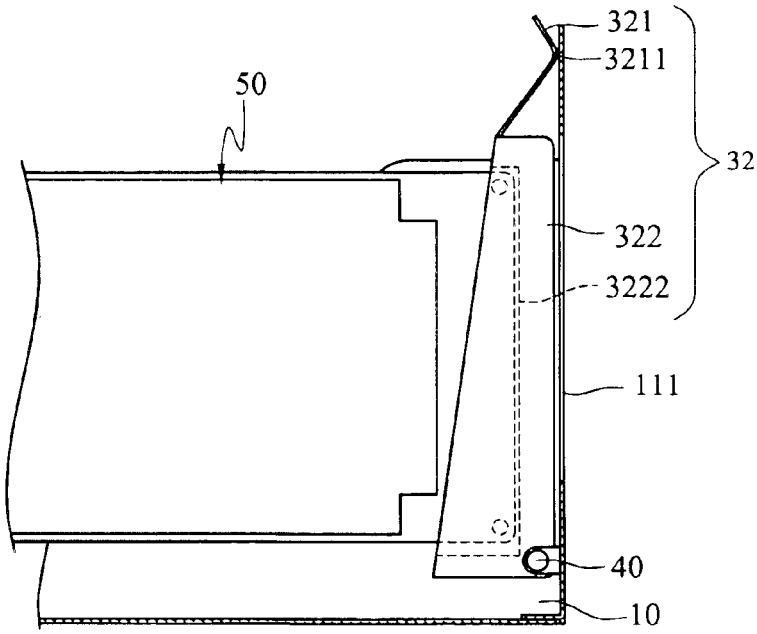

Referring to FIGS. 3A, 3B and 3C, when the interface card 50 is inserted in the bracket 10 through the trough 121, the elastic section 3211 of the elastic element 321 is moved to compress the inner side 11 where the opening 111 is formed to store elastic force, and the interface card 50 pushes the housing element 322 outwards through the opening 111. When the interface card 50 has been inserted in the housing trough 3222, the elastic force of the elastic section 3211 drives the elastic element 321 and the housing element 322 to their original positions to latch a corner of the interface card 50 so that a connector 51 of the interface card 50 is anchored in the insertion slot 211 of the main board 21.

By contrast, push the housing element 322 to compress the elastic section 3211 of the elastic element 321 to store the elastic force. The housing element 322 is turned outwards at the same time through the opening 111 and unlatches the corner of the interface card 50. Then the interface card 50 can be removed from the main board 21 through the trough 121 to disengage the connector 51 of the interface card 50 from the insertion slot 211 of the main board 21.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments, which do not depart from the spirit and scope of the invention.

What is claimed is:

1. An interface card anchoring structure mounted on a bracket in a case of an electronic device corresponding to an insertion slot of a main board of the case, the bracket having two opposing inner sides which have respectively an opening and a trough formed thereon, the anchoring structure comprising:

a pivot lug located on the inner side where the opening is formed; and a coupling assembly including:

an elastic element; and a housing element which has one end connecting to the elastic element and the other end pivotally coupled on the pivot lug, and a housing trough corresponding to an interface card and remote from the opening;

wherein the interface card is insertable in the bracket through the trough to compress the elastic element against the inner side where the opening is formed to store elastic force and push the housing element outwards through the opening, and the elastic force drives the elastic element and the housing element to their original positions when the interface card has been wedged in the housing trough to latch one corner of the interface card and anchor a connector of the interface card in the insertion slot of the main board.

2. The interface card anchoring structure of claim 1, wherein the elastic element is an elastic reed.

3. The interface card anchoring structure of claim 2, wherein the elastic element includes an elastic section compressing the inner side where the opening is formed.

4. The interface card anchoring structure of claim 1, wherein the pivot lug has a pivot hole and the housing element has an aperture corresponding to the pivot hole to engage with the pivot hole through a fastening element to couple the pivot lug with the housing element.

* * * * *